US006592469B2

(12) United States Patent
Gilbert

(10) Patent No.: US 6,592,469 B2
(45) **Date of Patent: *Jul. 15, 2003**

(54) GOLF CLUB HEADS WITH BACK CAVITY INSERTS AND WEIGHTING

(75) Inventor: Peter J. Gilbert, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/768,818

(22) Filed: Jan. 25, 2001

(65) Prior Publication Data

US 2002/0098910 A1 Jul. 25, 2002

(51) Int. Cl.[7] ..... A63B 53/04; A63B 53/06; A63B 53/08

(52) U.S. Cl. ..... 473/350; 473/291

(58) Field of Search ..... 473/288, 290, 473/291, 251, 324, 329, 340, 342, 347, 350, 349, 334–339

(56) References Cited

U.S. PATENT DOCUMENTS

| | | | |
|---|---|---|---|
| 2,846,228 | A | 8/1958 | Reach |
| 3,863,932 | A | 2/1975 | Lezatte |
| 3,970,236 | A | 7/1976 | Rogers |
| 4,027,885 | A | 6/1977 | Rogers |
| 4,121,832 | A | 10/1978 | Ebbing |
| 4,213,613 | A | 7/1980 | Nygren |
| 4,523,759 | A | 6/1985 | Igarashi |
| 4,545,580 | A | 10/1985 | Tomita et al. |
| 4,635,941 | A | 1/1987 | Yoneyama |
| 4,681,321 | A | 7/1987 | Chen et al. |
| 4,740,345 | A | 4/1988 | Nagasaki et al. |
| 4,778,185 | A | 10/1988 | Kurokawa |
| 4,792,139 | A | 12/1988 | Nagasaki et al. |
| 4,792,140 | A | 12/1988 | Yamaguchi et al. |
| 4,793,616 | A | 12/1988 | Fernandez |
| 4,798,382 | A | 1/1989 | Janes |
| 4,798,383 | A | 1/1989 | Nagasaki et al. |
| 4,809,978 | A | 3/1989 | Yamaguchi et al. |
| 4,824,110 | A | 4/1989 | Kobayashi |
| 4,848,747 | A | 7/1989 | Fujimura et al. |
| 4,874,171 | A | 10/1989 | Ezaki et al. |
| 4,883,275 | A | 11/1989 | Boone |

(List continued on next page.)

FOREIGN PATENT DOCUMENTS

| | | |
|---|---|---|
| JP | 5-305161 | 11/1993 |
| JP | 6-344519 | 12/1994 |
| JP | 7-313635 | 12/1995 |
| JP | 7-313636 | 12/1995 |
| JP | 8-173578 | 7/1996 |
| JP | 8-215352 | 8/1996 |
| JP | 8-280855 | 10/1996 |
| JP | 9-47527 | 2/1997 |
| JP | 9-70455 | 3/1997 |
| JP | 9-173513 | 7/1997 |
| JP | 9-192275 | 7/1997 |
| JP | 9-285572 | 11/1997 |
| JP | 9-84906 | 2/1998 |
| JP | 10-258143 | 9/1998 |
| JP | 11-290488 | 10/1999 |
| JP | 2000-42149 | 2/2000 |
| JP | 2000-73028 | 3/2000 |
| JP | 2000-325506 | 11/2000 |

*Primary Examiner*—Paul T. Sewell
*Assistant Examiner*—M. Chambers
(74) *Attorney, Agent, or Firm*—Swidler Berlin Shereff Friedman, LLP

(57) ABSTRACT

Golf club heads and sets of golf club heads are provided with a thin front face for striking a golf ball and a peripheral weighting surrounding the back of the front face and defining a cavity. An insert is formed in the cavity behind at least a portion of the front face. The golf club heads may also include a weight member which is locked onto the club head by the insert.

21 Claims, 20 Drawing Sheets

U.S. PATENT DOCUMENTS 4,884,812 A 12/1989 Nagasaki et al.
4,928,972 A * 5/1990 Nakanishi et al. ..... 473/332
4,964,640 A 10/1990 Nakanishi et al.
5,004,242 A * 4/1991 Iwanaga et al. ..... 473/347
5,009,425 A 4/1991 Okumoto et al.
5,016,882 A 5/1991 Fujimura et al.
5,016,883 A 5/1991 Kobayashi
5,024,437 A 6/1991 Anderson
5,062,638 A 11/1991 Shira
5,064,197 A 11/1991 Eddy
5,078,397 A 1/1992 Aizawa
5,094,383 A 3/1992 Anderson et al.
5,154,425 A 10/1992 Niskanen et al.
5,184,823 A 2/1993 Desboilles et al.
5,190,290 A 3/1993 Take
5,217,227 A 6/1993 Shira
5,221,087 A 6/1993 Fenton et al.
5,228,694 A 7/1993 Okumoto et al.
5,242,168 A 9/1993 Aizawa
5,261,663 A 11/1993 Anderson
5,288,070 A 2/1994 Chen
5,290,036 A 3/1994 Fenton et al.
5,310,185 A 5/1994 Viollaz et al.
5,312,105 A 5/1994 Cleveland
5,312,106 A 5/1994 Cook
5,316,298 A 5/1994 Hutin et al.
5,326,106 A 7/1994 Meyer
5,342,812 A 8/1994 Niskanen et al.
5,346,213 A 9/1994 Yamada
5,346,216 A 9/1994 Aizawa
5,348,302 A 9/1994 Sasamoto et al.
5,358,249 A 10/1994 Mendralla
5,362,055 A 11/1994 Rennie
5,377,986 A 1/1995 Viollaz et al.
5,398,929 A 3/1995 Kitaichi
5,403,007 A 4/1995 Chen
5,411,255 A 5/1995 Kurashima et al.
5,411,264 A 5/1995 Oku
5,417,419 A 5/1995 Anderson et al.
5,425,535 A 6/1995 Gee
5,447,311 A 9/1995 Viollaz et al.
5,472,201 A 12/1995 Aizawa et al.
5,480,152 A 1/1996 Schmidt et al.
5,489,098 A 2/1996 Gojny et al.
5,499,819 A 3/1996 Nagamoto
5,516,107 A 5/1996 Okumoto et al.
5,522,593 A 6/1996 Kobayashi et al.
5,524,331 A 6/1996 Pond
5,529,543 A 6/1996 Beaumont, Sr.
5,540,436 A 7/1996 Boone
5,570,886 A 11/1996 Rigal et al.
5,575,472 A 11/1996 Magerman et al.
5,586,947 A 12/1996 Hutin
5,588,923 A 12/1996 Schmidt et al.
5,590,881 A 1/1997 Jernigan
5,595,234 A 1/1997 Beck
5,595,548 A 1/1997 Beck
5,605,511 A 2/1997 Schmidt et al.
5,616,088 A 4/1997 Aizawa et al.
5,626,530 A 5/1997 Schmidt et al.
5,658,208 A 8/1997 Shimasaki
5,674,133 A 10/1997 Chang et al.
5,697,855 A 12/1997 Aizawa
5,707,302 A 1/1998 Leon et al.
5,713,800 A 2/1998 Su
5,738,596 A 4/1998 Meyer
5,749,794 A 5/1998 Kobayashi et al.
5,766,092 A 6/1998 Mimeur et al.
5,766,093 A 6/1998 Rohrer
5,772,527 A 6/1998 Liu
5,797,807 A 8/1998 Moore
5,800,282 A 9/1998 Hutin et al.
5,842,935 A 12/1998 Nelson
5,899,821 A 5/1999 Hsu et al.
5,931,746 A * 8/1999 Soong ..... 473/329
5,935,019 A * 8/1999 Yamamoto ..... 473/338
5,967,903 A 10/1999 Cheng
5,997,414 A 12/1999 Dalton
6,027,415 A 2/2000 Takeda
6,030,293 A 2/2000 Takeda
6,030,295 A 2/2000 Takeda
6,042,486 A 3/2000 Gallagher
6,045,456 A 4/2000 Best et al.
6,062,988 A 5/2000 Yamamoto
6,080,069 A 6/2000 Long
6,083,118 A 7/2000 Martins et al.
6,086,485 A 7/2000 Hamada et al.
6,102,812 A 8/2000 Takeda
6,117,022 A 9/2000 Crawford et al.
D432,611 S * 10/2000 McCabe et al. ..... D21/759
6,152,833 A 11/2000 Werner et al.
6,186,903 B1 2/2001 Beebe et al.
6,200,229 B1 3/2001 Grace et al.
6,206,790 B1 3/2001 Kubica et al.
6,217,460 B1 4/2001 Broadbridge et al.
6,227,986 B1 5/2001 Fisher
6,238,302 B1 5/2001 Helmstetter et al.
6,238,303 B1 5/2001 Fite
6,290,607 B1 * 9/2001 Gilbert et al. ..... 473/291

* cited by examiner

GOLF CLUB HEADS WITH BACK CAVITY INSERTS AND WEIGHTING

TECHNICAL FIELD OF THE INVENTION

The present invention generally relates to a golf club head with a composite insert disposed in a back cavity. More particularly, the present invention relates to golf club heads with composite inserts and weight members locked thereto.

BACKGROUND OF THE INVENTION

A conventional iron golf club has a club head with a striking face for impacting a golf ball, with the angle between the face and a vertical plane known as the "loft." Irons are typically grouped in a set that includes clubs with numerical designations 1 through 9, along with a series of wedges such as a pitching wedge, lob wedge, gap wedge and sand wedge. The length of the irons usually decreases through the set as the loft for each club head increases from the long irons to the short irons. The length of the club, along with the club head loft and center of gravity, impart various performance characteristics to the ball's launch conditions upon impact.

Most conventional club heads are made of one homogenous material. This type of construction, however, imposes design constraints on the head configuration, thus limiting the opportunity to produce an iron with forgiving play characteristics while at the same time maintaining a traditional sized head. The use of one homogenous material also may limit the positioning of the head's center of gravity.

To avoid the disadvantages of homogenous construction, it is known to manufacture club heads from a combination of materials. Such a construction advantageously permits the use of materials with various densities for the production of novel club heads. Materials suitable for incorporation in club head designs include composites, such as carbon fiber or graphite. The use of these materials, however, presents challenges in manufacture, because the components must be rugged. The several materials must be locked together in a reliable manner that will avoid separation after considerable use. In addition, the materials must resist breakage due to the loading on the club, and furthermore, the materials must have acceptable wear resistance. Moreover, such materials cannot adversely affect the desired launch characteristics of the club head.

Thus, there exists a need for a golf club head that incorporates a composite construction. In particular, there exists a need for a composite construction that can securely and integrally lock the several components of the club head together, while also providing desirable launch characteristics, durability and wear resistance.

SUMMARY OF THE INVENTION

The present invention is directed to golf club heads. Each golf club head includes a front face having a substantially uniform thickness of less than about 0.125 inches, a perimeter weighting surrounding a substantial portion of the front face and defining a back cavity therein and an insert located in the back cavity. The insert includes a lower portion having a first maximum thickness and an upper portion having a second maximum thickness that is less than or equal to the first and having at least a portion of the upper portion having a thickness less than the first maximum thickness. In one embodiment, the insert may include an intermediate portion extending between the upper and lower portions and having a third maximum thickness that is less than or equal to the second and at least a portion of the intermediate portion having a thickness less than the second maximum thickness.

According to one aspect of the invention, the front face thickness is less than about 0.115 inches.

According to another aspect of the invention, the insert may be affixed into the back cavity adhesively, by press fitting, or by molding. The insert can be further locked into the back cavity by an undercut defined in the perimeter weighting. The insert can be comprised of fiber reinforced resin, and a vibration absorber, such as a thin layer of rubber or Kevlar, may optionally be disposed between the insert and the back cavity.

In another embodiment of the present invention, the club heads further include a weight member having a specific gravity of greater than about 10 that is juxtaposed between a portion of the perimeter weighting and the insert. Alternatively, the weight member is coupled into an indentation in the perimeter weighting that is adjacent the back cavity, and the weight member is maintained in the indentation by the insert.

The front face may define a striking surface and the striking surface may be a material different from that of the perimeter weighting.

The present invention is further directed to a set of iron-type golf club heads. A first club head within the set has a face thickness of less than about 0.125 inches and each club head within the set has a face thickness that is equal to or greater than that of a next lower numbered club head in the set. Also, each club head within the set has a center of gravity that is at a height equal to or greater than that of a next lower numbered club head in the set. In one embodiment, each club head in the set further includes a weight member juxtaposed between the perimeter weighting and the insert. The weight member of each club head has a weight that is equal to or less than that of a next lower numbered club head in the set.

Furthermore, the present invention is directed to an iron-type club head that includes a front face of substantially uniform thickness, with the thickness being less than about 0.125 inches. The club head also includes perimeter weighting surrounding a substantial portion of the front face and defining a back cavity therein, and an insert located in at least a portion of the back cavity, with the insert formed of a composite fiber reinforced resin to support the front face. The insert may have a bottom portion with a first maximum thickness, a top portion with a second maximum thickness less than or equal to the first, and an intermediate portion extending between the top and bottom portions and having a third maximum thickness less than or equal to the second.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
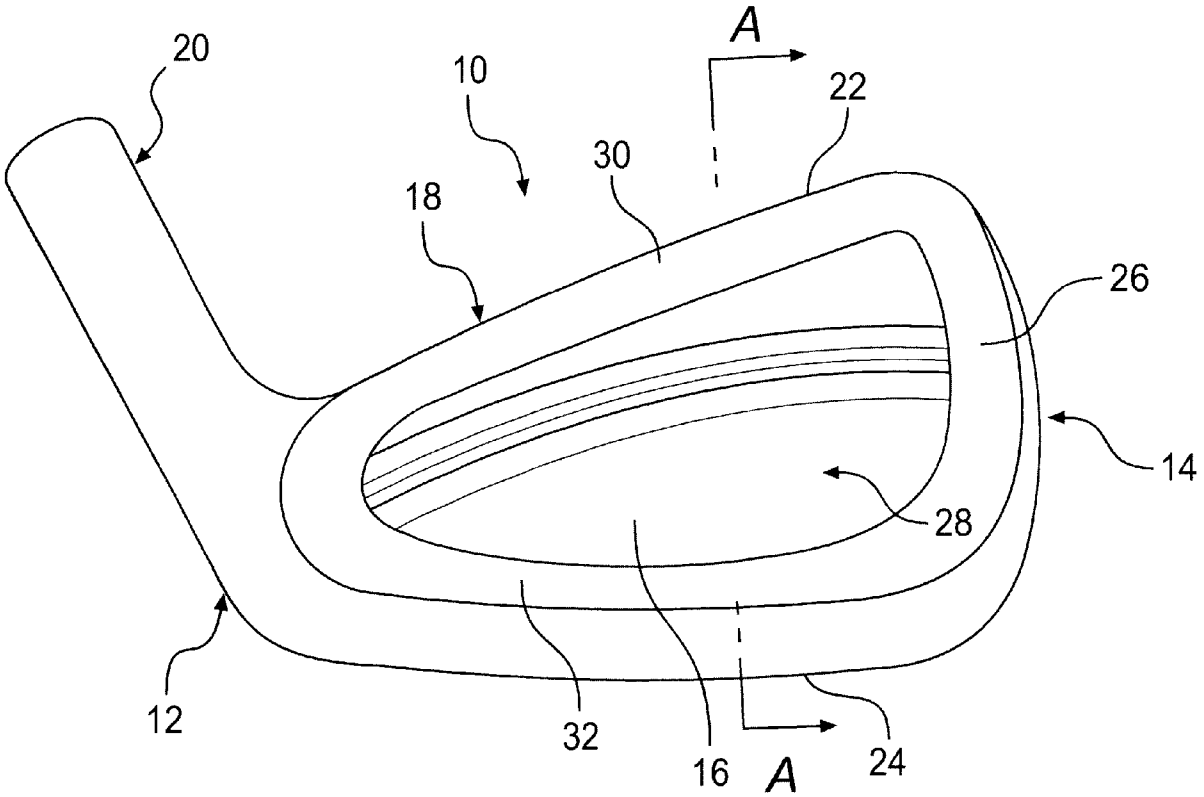
FIG. 1 is a back view of a golf club head of the present invention.

Referring to FIG. 1, a back view of an iron golf club head 10 is shown. Golf club head 10 includes a heel 12, a toe 14, a back face 16 and a front face 18 opposite the back face 16. Front face 18 may include grooves and provides a striking surface for impact with a golf ball. A hosel 20 extends from heel 12 of head 10.

Head 10 further includes an upper surface or top edge portion 22 and a lower surface or sole 24. Both the top line 22 and the sole 24 extend from the heel 12 to the toe 14. Preferably, the back surface of head 10 further includes perimeter weighting 26 which defines a cavity 28. Peripheral weighting 26 has an upper portion 30 and a lower portion 32.

Figure 2:
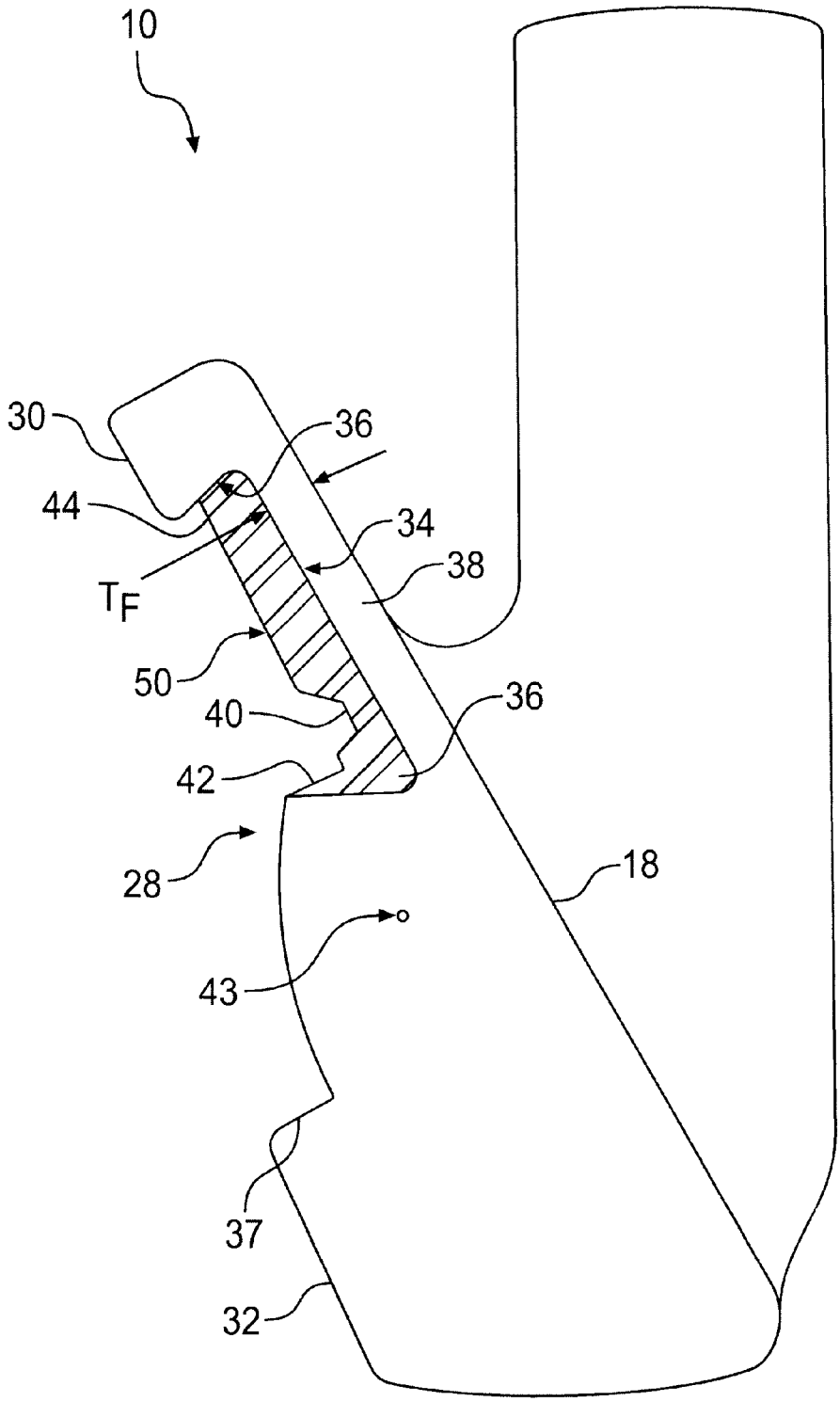
FIGS. 2–9 are cross-sectional views of variations of the golf club head of FIG. 1, taken along line A—A.
Figure 3:
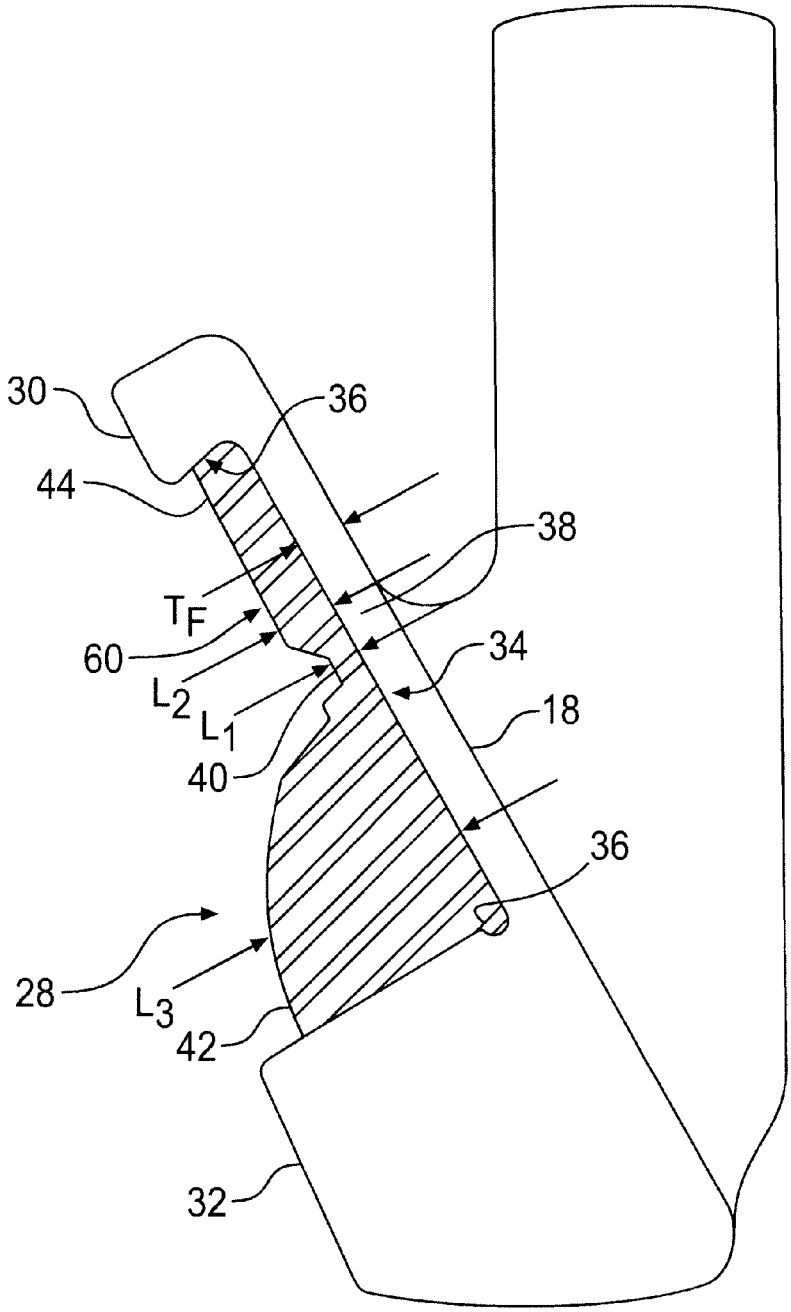
Figure 4:
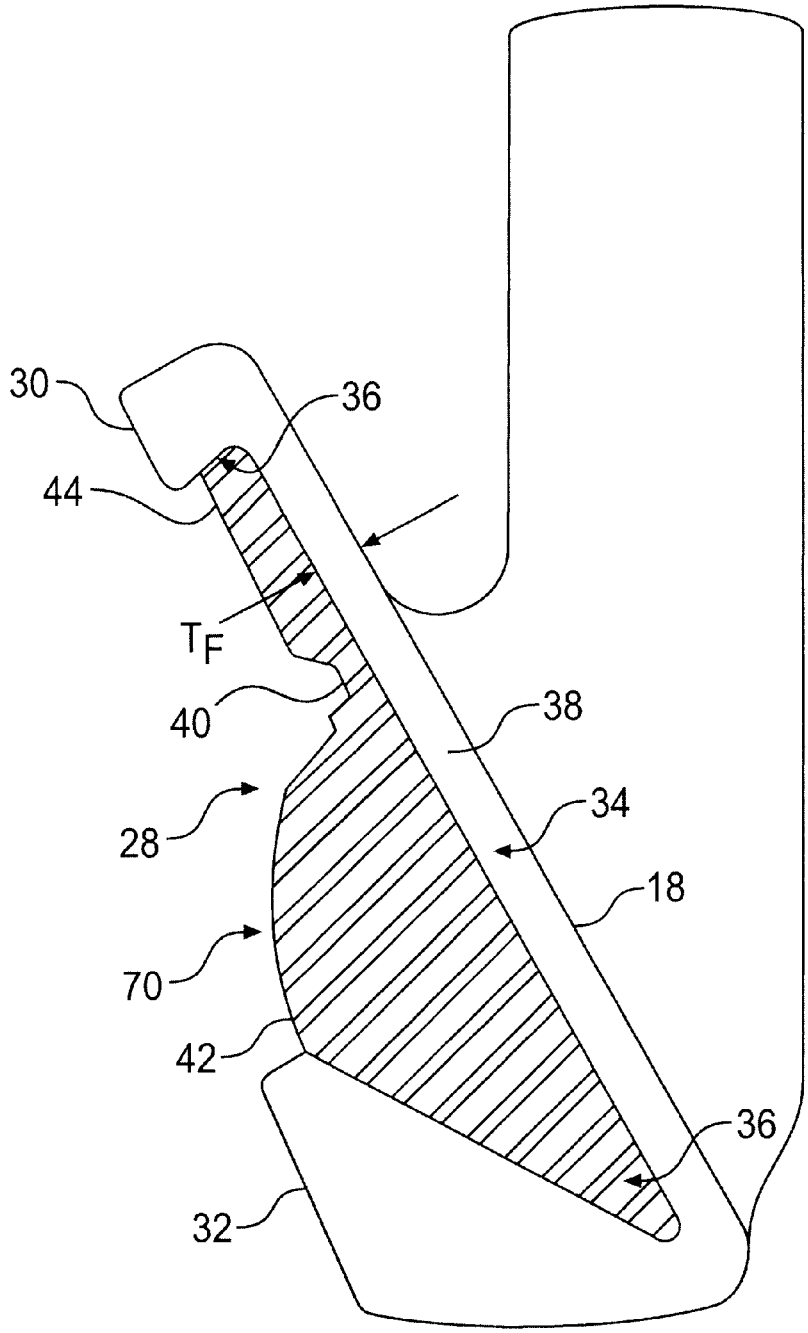

FIGS. 2, 3, and 4 show inserts 50, 60, 70, respectively, each disposed in a recessed portion 34 of club head 10. An undercut 36 is formed about the perimeter of recessed portion 34, and mates with an insert 50, 60, 70 to lock it to club head 10, thus providing a positive mechanical connection between club head 10 and the insert. Preferably, perimeter weighting 26 extends beyond insert 50, 60, 70 and further retains the insert in cavity 28, thus protecting the insert from impact.

Insert 50, 60, 70 can be compression molded, molded, or press fitted into recessed portion 34 or, alternatively, adhesively affixed thereto, thus eliminating the need for the undercut. If compression molding is used, for example, a composite material is locked to the body of the club with heat and pressure. Insert 50, 60, 70 can be formed from a variety of different materials including aluminum and injection molded composites, however, fiber reinforced resin is the preferred material. Due to their low weight, inserts formed of composite materials advantageously may permit redistribution of mass to the perimeter of the club head yielding a more forgiving club head with a softer feel. In addition, inserts 50, 60, 70 may have apertures, or "windows," formed therein to permit viewing of the construction of club head 10. In particular, weight elements extending from the sole into recessed portion 34 may be seen through such windows, as well as other materials locked within the area of the recessed portion or graphics placed behind the insert.

Still referring to FIGS. 2, 3, and 4, front face 18 includes a thin portion 38 adjacent recessed portion 34 that has a substantially uniform thickness $T_F$ which preferably is less than about 0.25 inches. More preferably, thickness $T_F$ is less than about 0.125 inches, and most preferably less than about 0.115 inches. According to one embodiment of the present invention, not shown, the surface of thin portion 38 that contacts an insert 50, 60, 70 may be reinforced with ribs, thickened sections, or other types of structural reinforcements known and appreciated by one skilled in the art. The combination of a thin front face 18 and an insert 50, 60, 70 provides a club head 10 with a soft feel on impact while at the same time maintaining the durability and launch characteristics of a traditional, metal-faced golf head.

Inserts 50, 60, 70 can be formed in various shapes and configurations to alter both the weight distribution and the center of gravity of club head 10 and, ultimately, to alter the play characteristics of head 10. For example, insert 50, shown in FIG. 2, is located proximate upper portion 30 of head 10, and does not extend to the bottom 37 of cavity 28. In contrast, inserts 60 and 70, shown in FIGS. 3 and 4, respectively, span the entire cavity 28 from upper portion 30 to lower portion 32. In addition, insert 70 extends into sole region 24 of club head 10 in a V-shaped configuration, which further assists in retaining the insert in cavity 28.

Preferably, each insert 50, 60, 70 has varying thickness. As seen for example in FIG. 3, insert 60 has an intermediate portion 40 with a first lateral thickness $L_1$, an upper portion 44 with a second lateral thickness $L_2$ greater than the first lateral thickness $L_1$, and a lower portion 42 that includes a region with a third lateral thickness $L_3$ greater than the second lateral thickness $L_2$. With regard to the center of gravity, as shown in FIG. 2, club head 10 is provided with a small insert near upper portion 30, and thus the center of gravity of the club head is located below the insert near point 43. Such a club head, for example, is designed as a short iron. In contrast, the larger insert of FIG. 3 is suitable for a long iron. The size of the insert also has bearing on the overall construction of club head 10 because as the insert size is increased, more of the region behind front face 18 from upper surface 22 to sole 24 is reinforced by the insert. Thus, a uniformly thin face may be provided from upper surface 22 to sole 24, as shown in FIG. 4, if adequate insert-derived reinforcement is provided behind it.

Figure 2A:
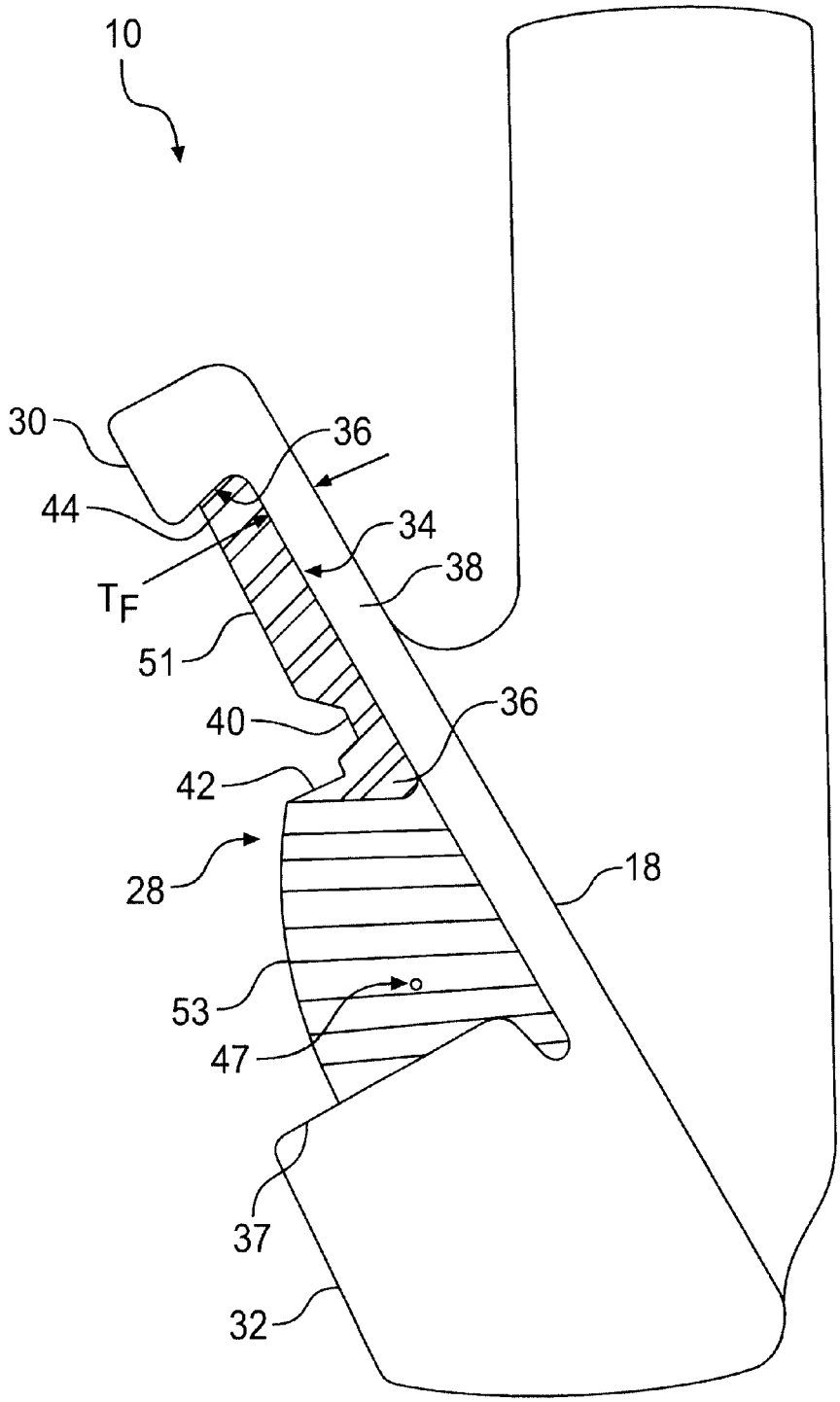
Figure 2B:
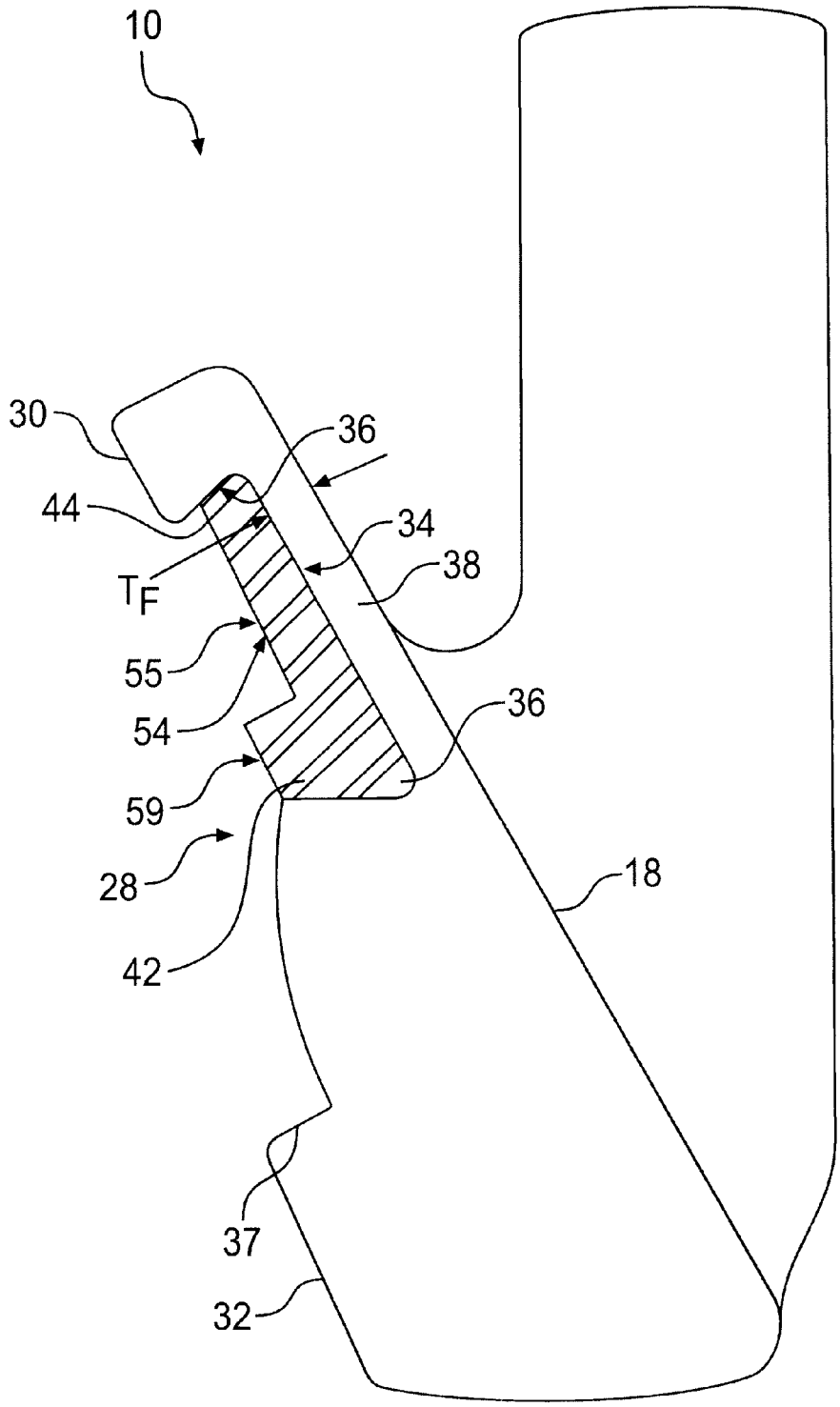
Figure 2C:
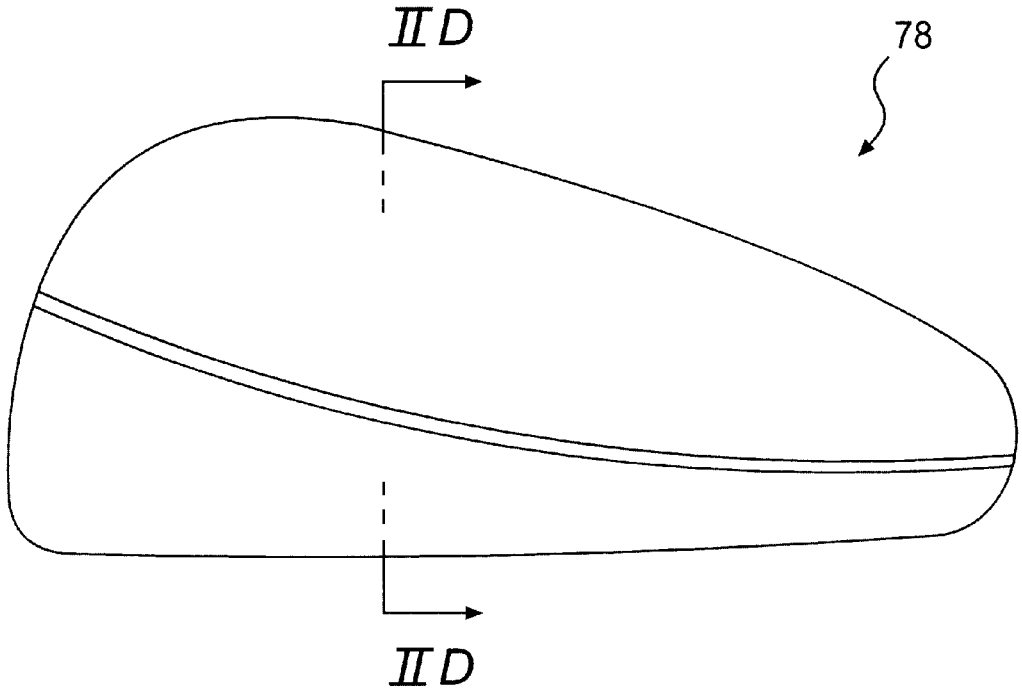
Figure 2D:
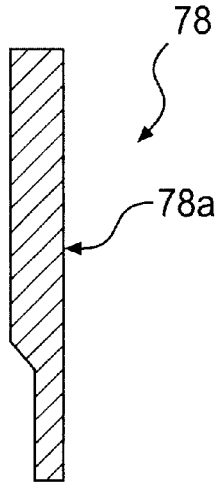

In an alternate embodiment, shown in FIG. 2A, two inserts 51, 53 are provided, locking each other in place. As shown, the center of gravity 47 of this long iron is lower than the center of gravity 43 of the short iron of FIG. 2. Although fiber reinforced resins is a preferred insert material, inserts 51, 53 for example may be formed of aluminum and tungsten, respectively. In another alternate embodiment, as shown in FIG. 2B, insert 54 includes a top portion 55 and a bottom portion 59, with the thickness of portion 55 as measured in a plane perpendicular to the face being less than the thickness of portion 59 as similarly measured. A further embodiment of a composite insert 78 is shown in FIG. 2C, and in cross-section in FIG. 2D. Insert 78 may be in the form of a composite shell, i.e., back face 78*a* may include a recess that has lead tape added to achieve particular weighting, and then locked in place with an epoxy resin.

Figure 3A:
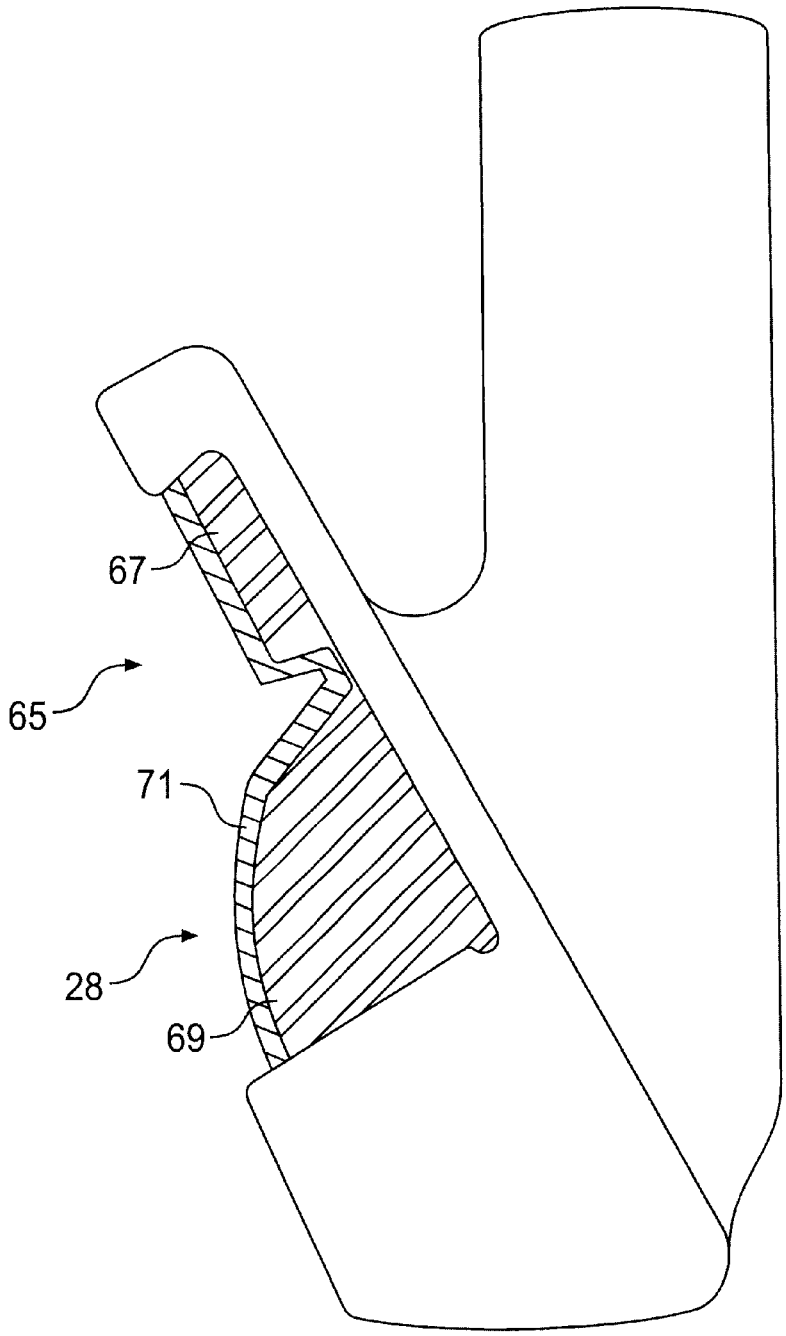

In yet another alternate embodiment shown in FIG. 3A, an insert 65 includes an upper and lower weights 67, 69, held in spaced relation to each other by back plate 71. Preferably, upper weight 67 is formed of a tungsten-filled polymer with an overall weight of 1 gram, 5 grams, or 10 grams, while lower weight 69 is formed of a tungsten-filled polymer with an overall weight of 30 grams, 35 grams, or 40 grams. To obtain a high center of gravity, upper and lower weights 67, 69 may be 10 grams and 30 grams, respectively, while a comparatively low center of gravity may be achieved when upper and lower weights 67, 69 are 1 gram and 40 grams, respectively.

Figure 5:
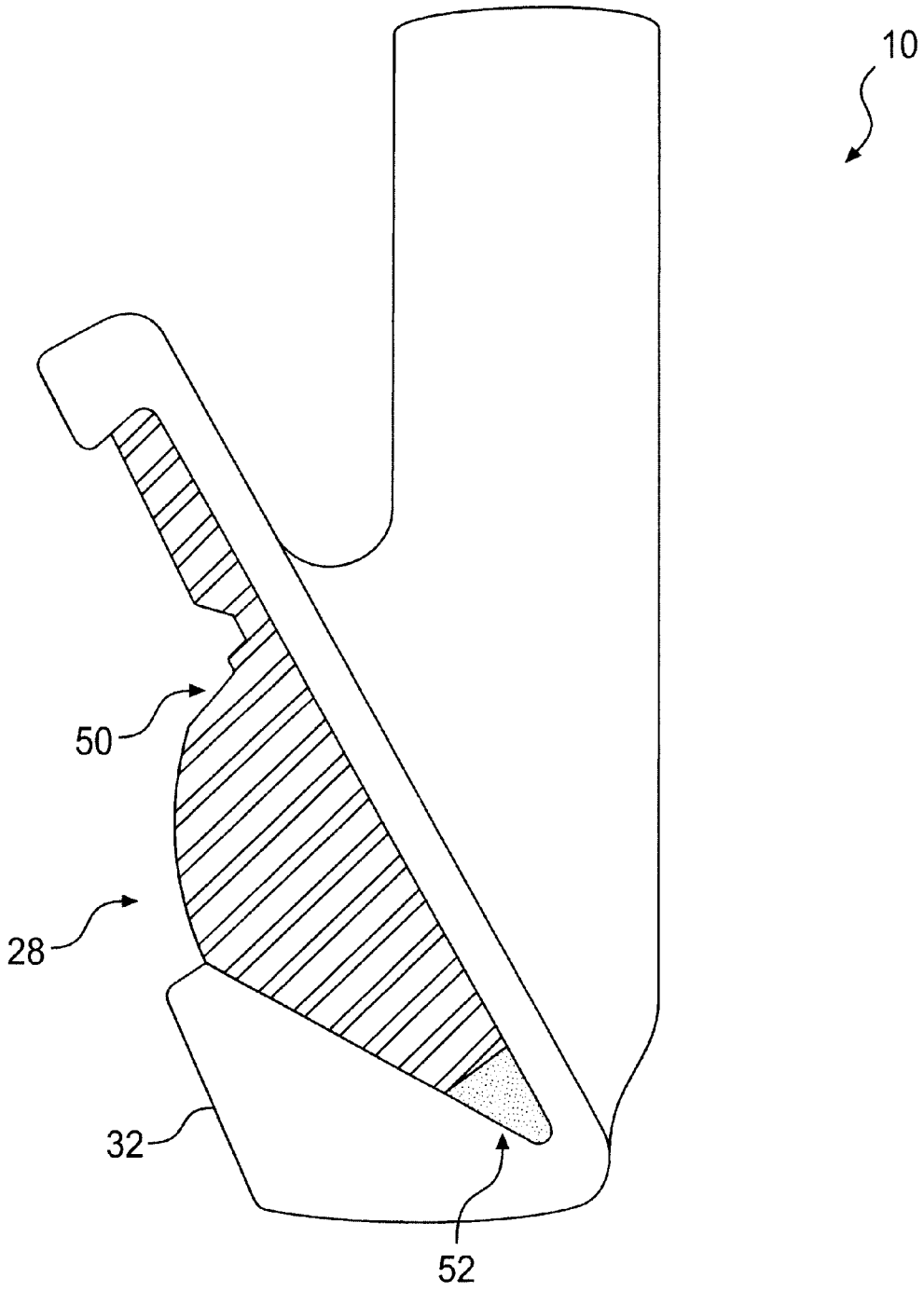

FIGS. 5–11 show weight members 52, 62, 72, 82, 92, which are incorporated into club head 10. Weight member 52, shown in FIG. 5, is located between insert 50 and lower portion 32. Weight member 52 is locked in place by insert 50, which presses weight member 52 into a portion of undercut 36. Weight member 52 can be in various forms, such as a solid plug, pellets, ball bearings or metal powder such as tungsten powder. Use of such a weighting scheme permits a desired weight for the club head to be met regardless of the overall design of the head. In particular, if a heavier head is desired, additional volume of weighting can be added to the head prior to locking of an insert thereto. To assist in manufacture of a club head with powder weighting, as shown for example in FIG. 5, the powder first may be placed in the lower region of cavity 28, and a layer of quick dry epoxy may be applied thereon to secure the powder in place. The insert may then be locked into the cavity.

Figure 6:
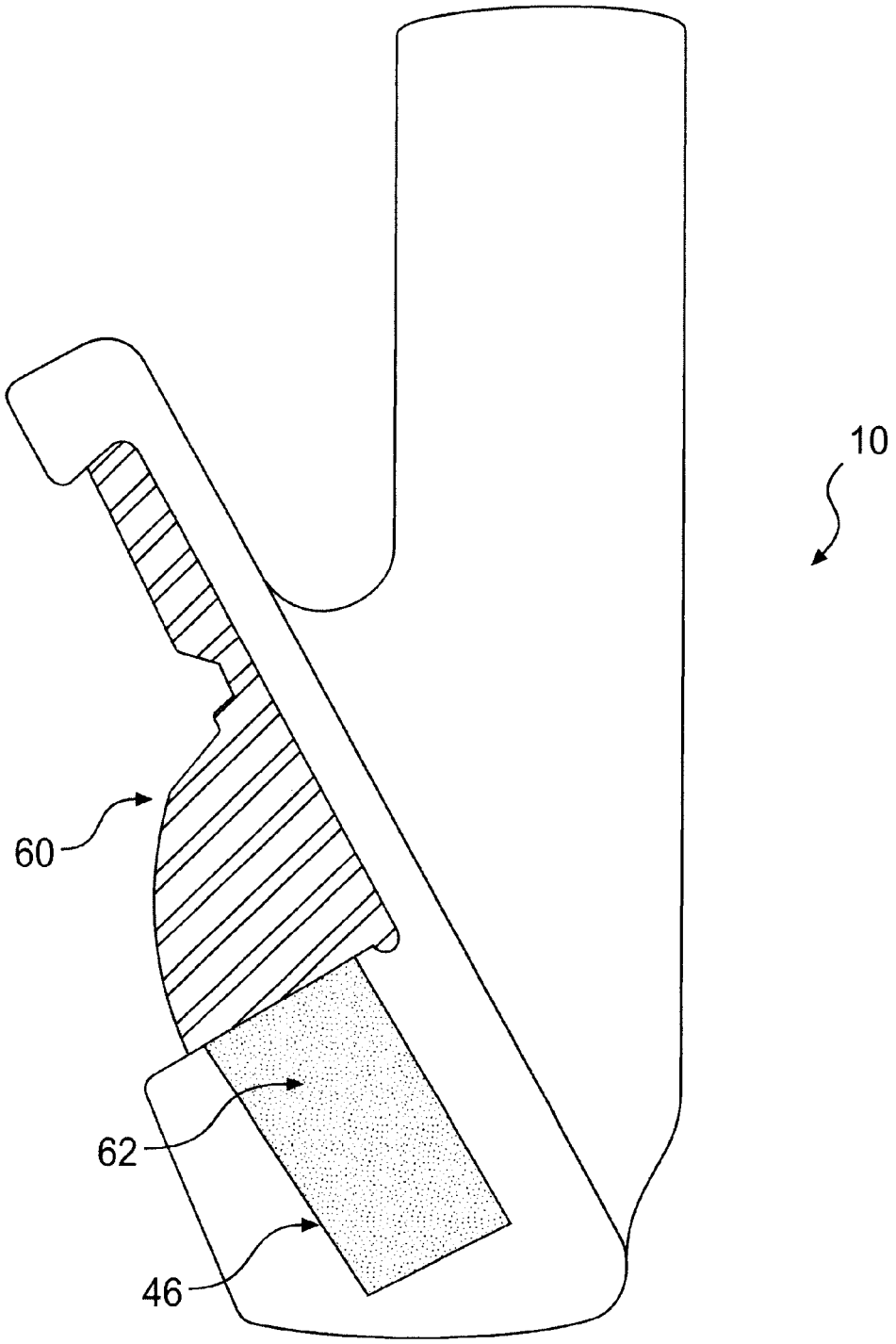
Figure 7:
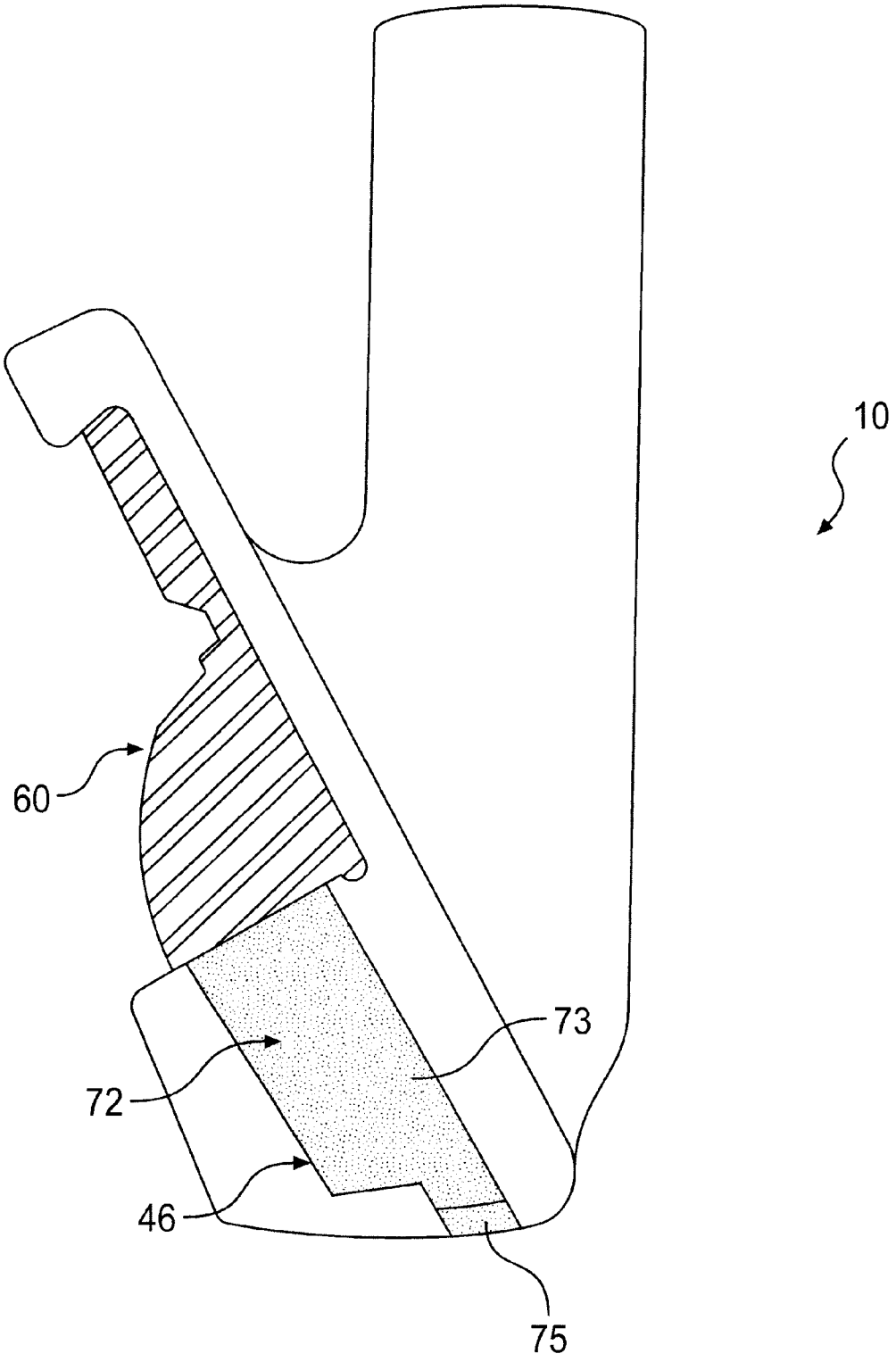
Figure 7A:
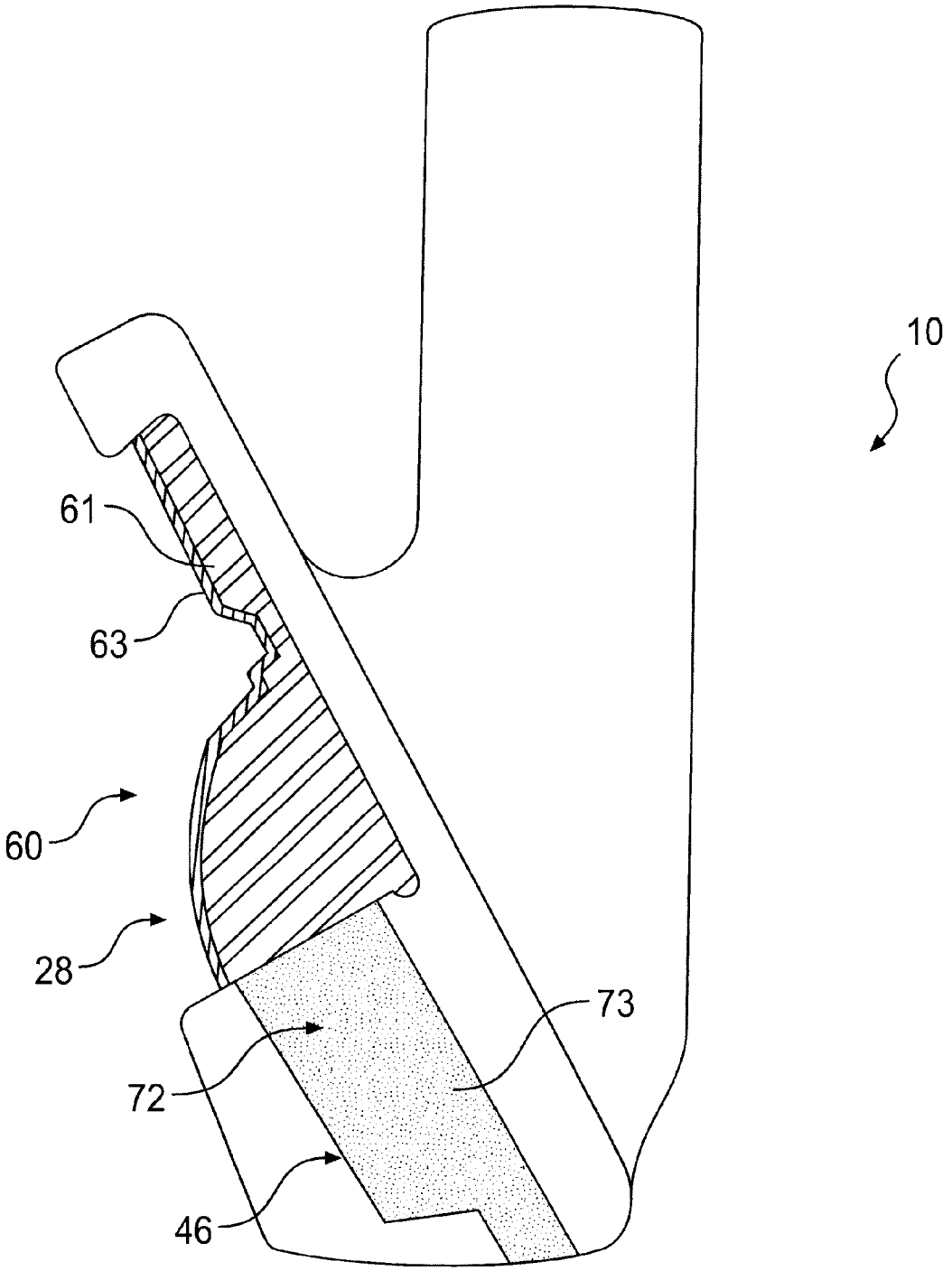

Weight members 62, 72, 82, 92 shown in FIGS. 6–9, respectively, are located in a chamber 46 in lower portion 32 of perimeter weight 26 and are locked therein by insert 60 or by a pin 48 in cooperation with insert 60. As shown in FIG. 6, a rigid tungsten plug is locked in place by a compression-molded composite. In the embodiment of FIG. 7, chamber 46 is connected to sole 24, through perimeter weighting 26, such that weight member 72 is visible on sole 24 and forms a portion of the surface thereof. Weight member 72 is further configured and dimensioned such that it cannot pass through the opening, thereby allowing weight member 72 to be locked into chamber 46 by insert 60. In one embodiment, weight member 72 includes top and bottom portions 73, 75 formed of materials with different densities and/or colors. For example, for aesthetic effect, bottom portion 75 may be formed of red, tungsten-copper with a density of 11–14 gm/cc, while top portion 73 may be formed of a material with a higher density such as 17–19 gm/cc. In another embodiment, shown in FIG. 7A, insert 60 includes a primary insert portion 61 that is encapsulated in cavity 28 by an encapsulating layer 63, which for example may be in the form of a coating or other sealant.

Figure 8:
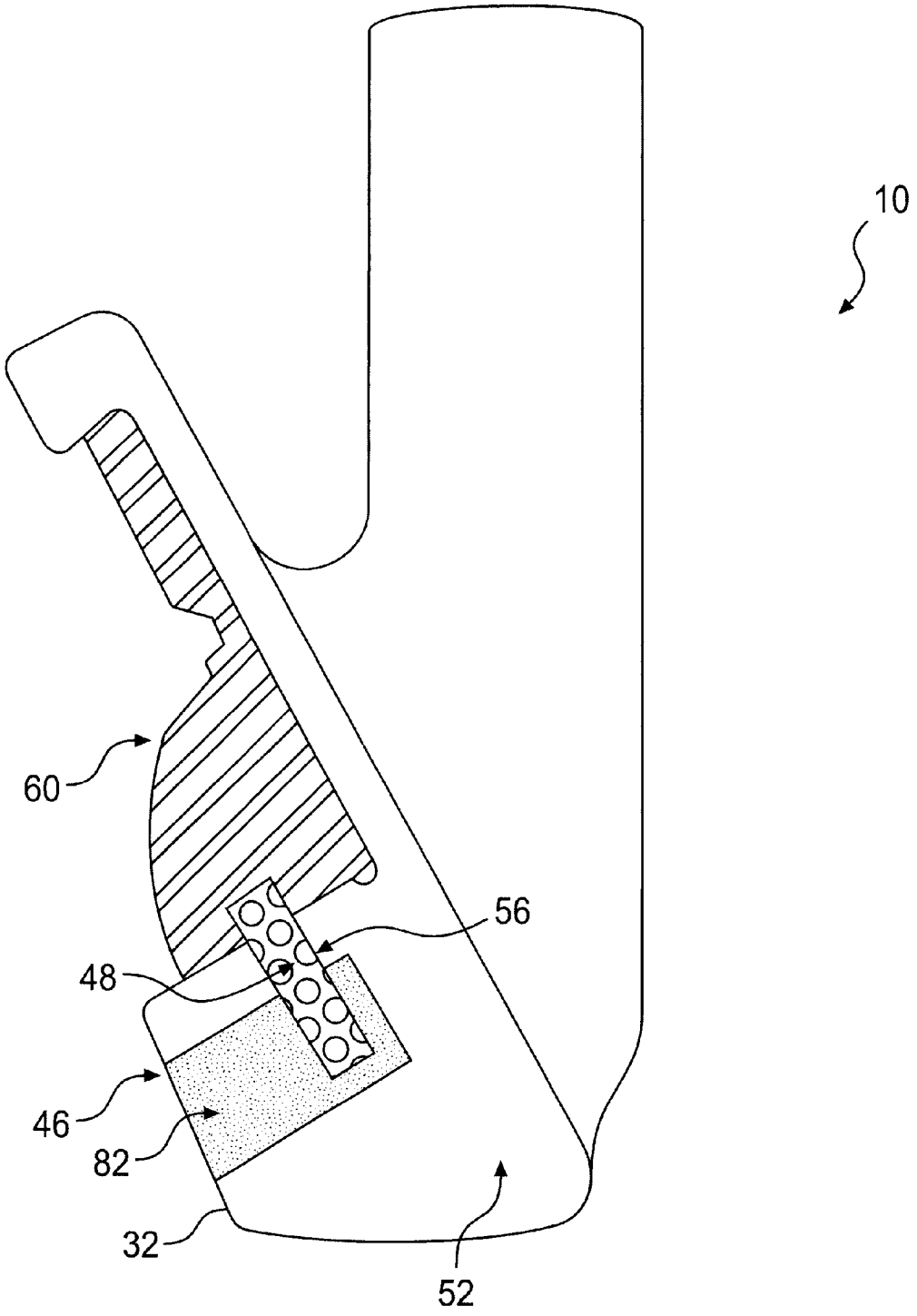
Figure 9:
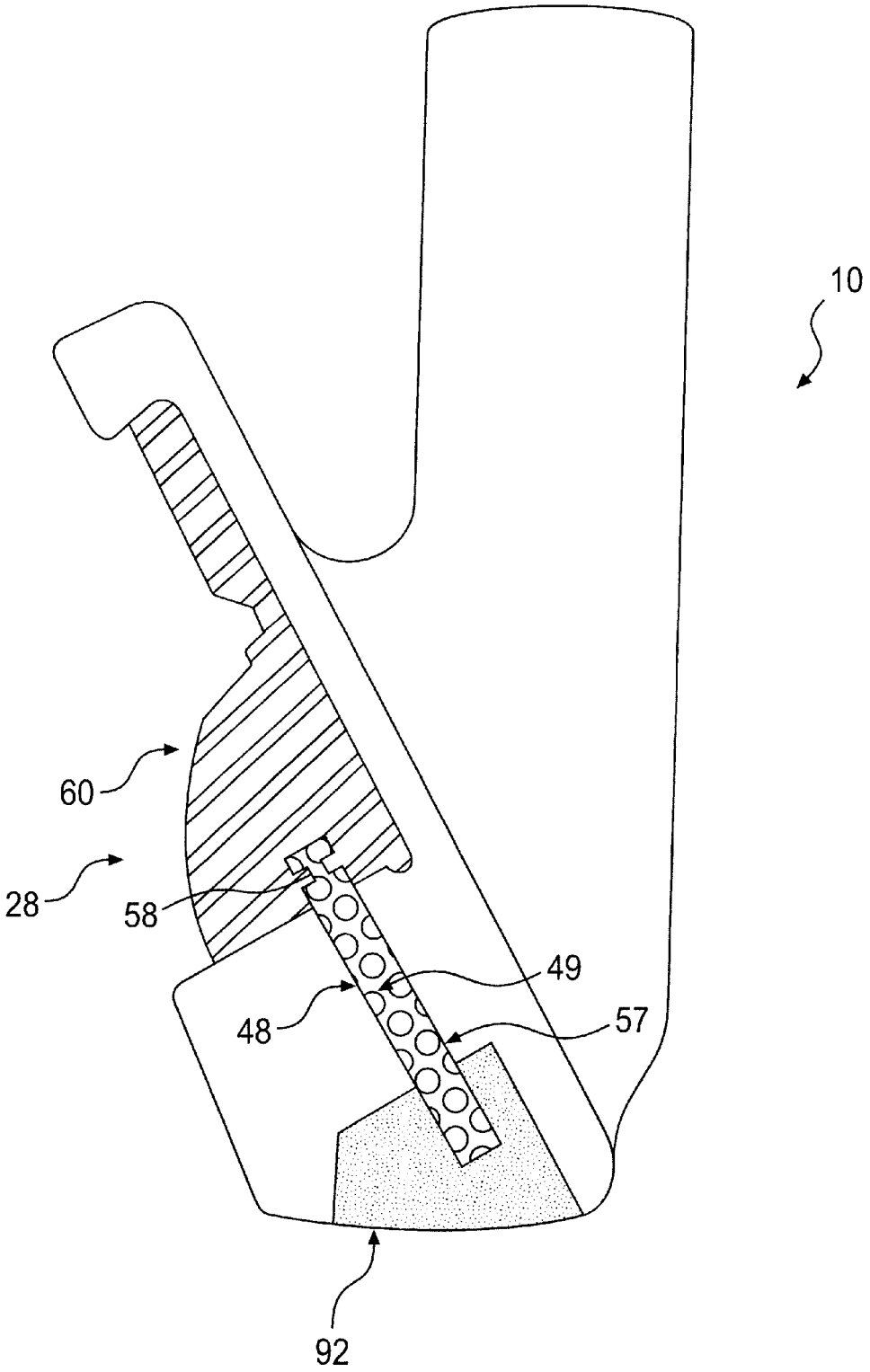

Weight member 82 may form a back plug if it extends within lower portion 32 but does not intersect sole 24, or alternatively weight member 82 may form a sole plug if it intersects sole 24. In the embodiment of FIG. 8, chamber 46 is located adjacent lower portion 32 and is disposed generally perpendicular to back face 16 of club head 10 for receiving a back plug weight member 82. In the embodiment of FIG. 9, chamber 46 extends to sole 24 of club head 10 and receives a sole plug weight member 92. Preferably, weight member 82, 92 is held in chamber 46 by a pin 48, 49, respectively. As shown in FIG. 8, pin 48 is received in a corresponding hole 56 that is formed in insert 60, club head 10 and weight member 82, and is oriented transverse to chamber 46. The transverse orientation of pin 48 prevents weight member 82 from sliding axially in chamber 46, and therefore locks weight member 82 to the club head 10.

As shown in FIG. 9, hole 57 extends from insert 60 into weight member 92. Pin 49 is fixed at one end to insert 60 and at the other to weight member 92 by compression molding, interference fitting, bonding, or other fixation means as known in the art, thus coupling weight member 92 to insert 60 and locking weight member 92 on club head 10. In one embodiment, pin 49 is threadably associated with weight member 92. During installation of the weight member, pin 49 is first screwed into a like-threaded hole in weight member 92. In order to minimize vibration, pin 49 may be inserted into a bed of epoxy in hole 57, thereby filling voids that remain between pin 49 and its surroundings. Next, insert 60 is compression molded into cavity 28, to surround pin 49. A circumferential groove 58 may be provided on pin 49 so that compression molded material surrounding pin 49 more securely retains insert 60 in cavity 28. In an alternate embodiment, pin 49 is adhesively bonded to insert 60 and weight member 92.

Figure 10:
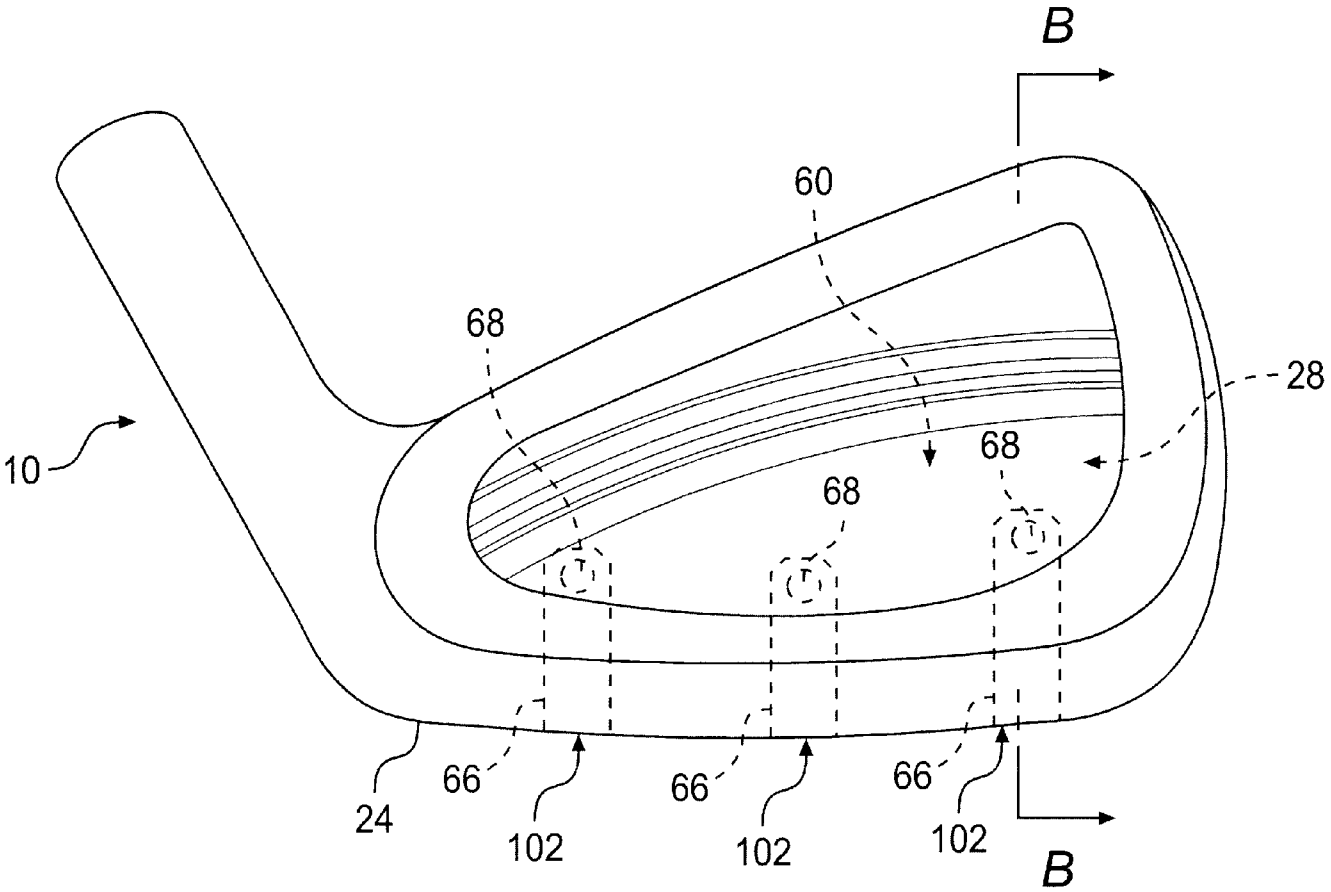
FIG. 10 is a back view of another embodiment of a golf club head according to the present invention.
Figure 11:
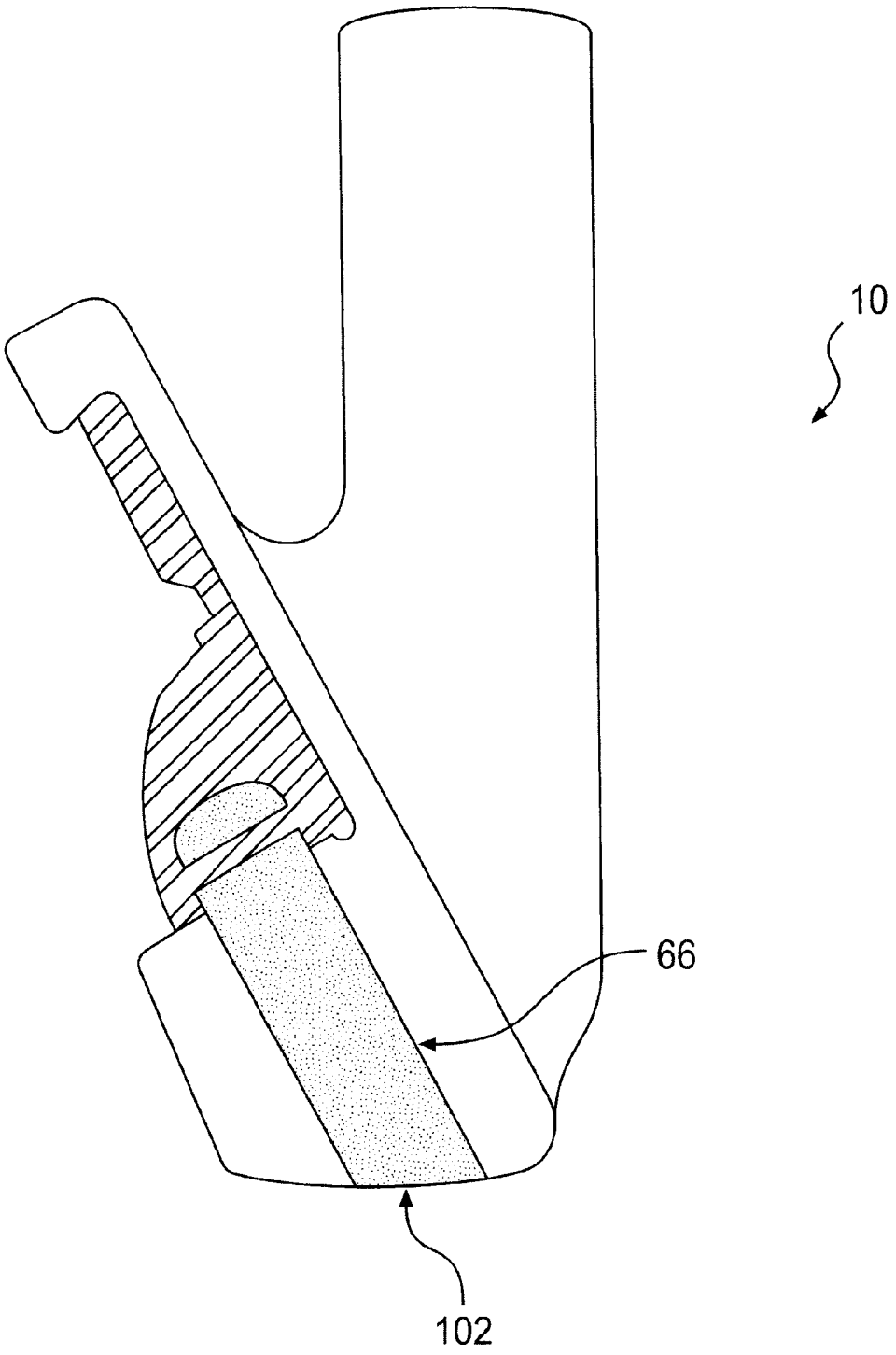
FIG. 11 is a cross-sectional view of the golf club head of FIG. 10, taken along line B—B.

FIGS. 10 and 11 show another variation of club head 10 having three pins 102 extending in holes 66 in sole 24. Pins 102 extend into cavity 28, and include through-holes 68 formed in an upper portion thereof. During compression molding of an insert 60 in cavity 28, composite material flows within through-holes 68. When cured in through-holes 68, the composite material is additionally retained in cavity 28.

Weight members such as 52, 62, 72, 82, 92, 102 may be constructed of various high density materials such as tungsten, tungsten loaded plastic, lead, or any other material having a higher specific gravity than the integral parts of club head 10. It is preferred, however, for the weight members to have a specific gravity of greater than 10. Also, the weight members can take various forms including, but not limited to, a solid, a plurality of pellets, ball bearings, or metal powder.

Figure 12:
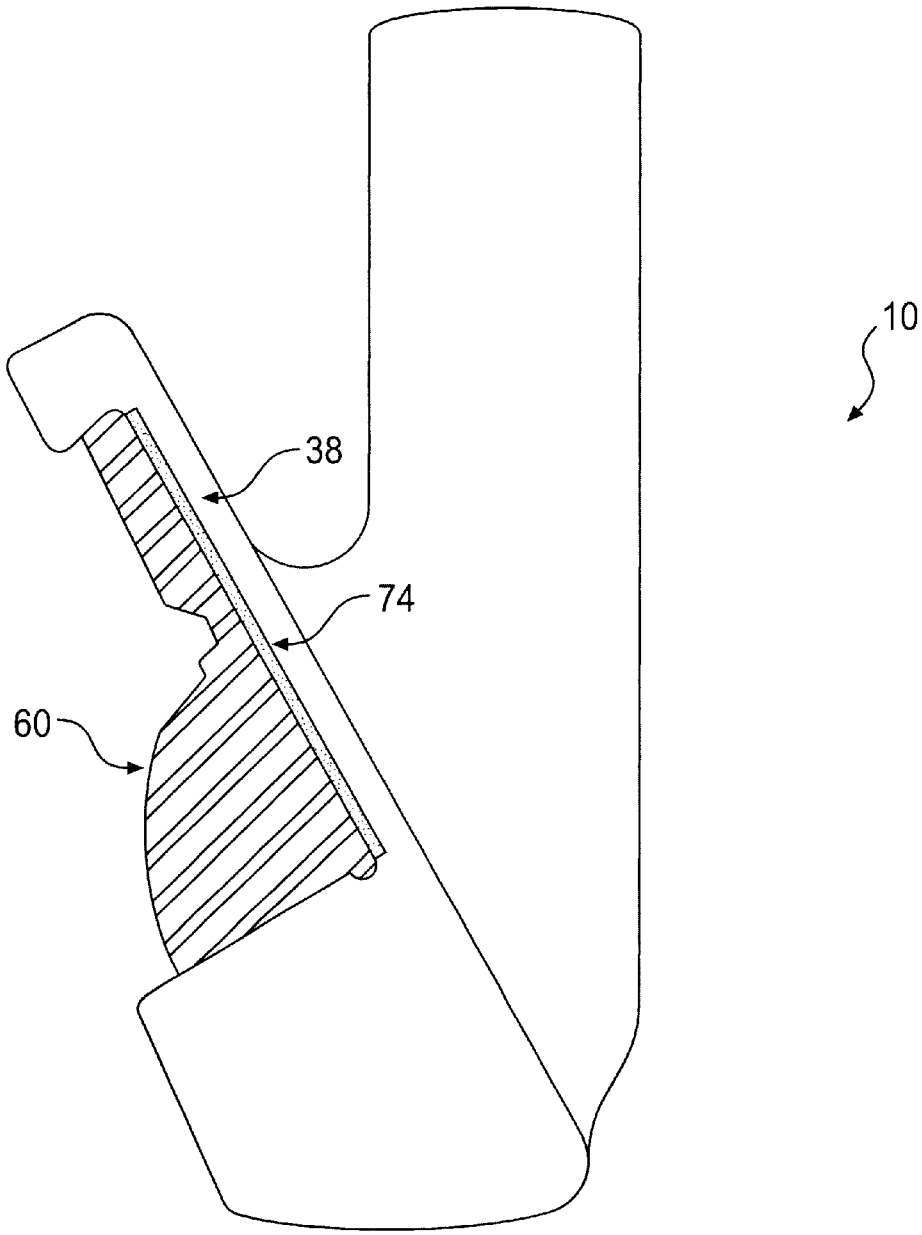
FIGS. 12 and 13 are cross-sectional views of two more embodiments of golf club heads according to the present invention and including a vibration absorbing media.
Figure 13:
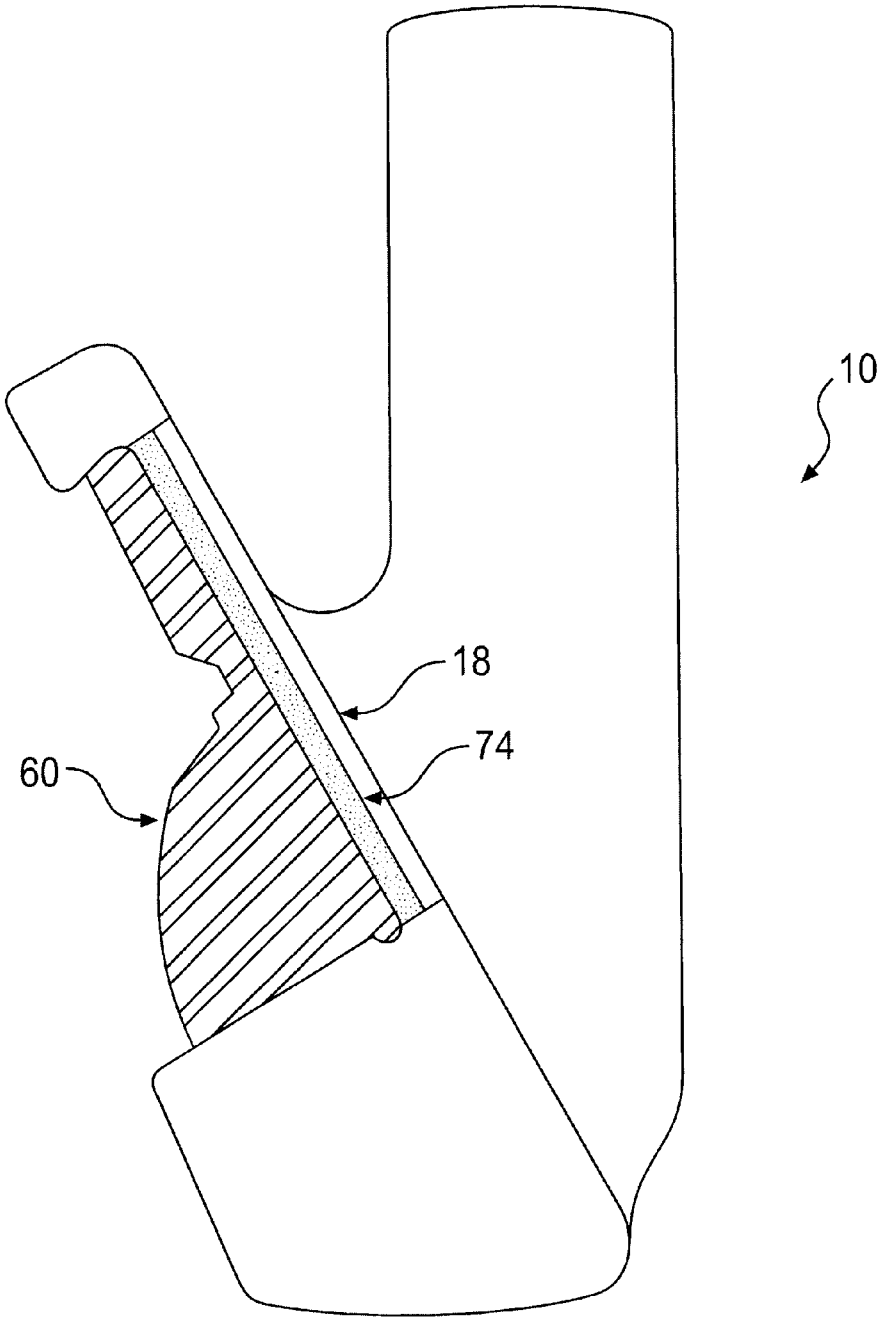

FIG. 12 shows club head 10 with a vibration absorber 74 sandwiched between insert 60 and thinner portion 38. Vibration absorber 74 helps to "soften" the club feel upon striking a golf ball, and can be formed of any vibration absorbing medium, such as Surlyn™, Kevlar or various types of rubber. FIG. 13 shows a slight variation of FIG. 12 where the front face 18 of club head 10 is constructed of a material different than the rest of club head 10. Front face 18 can be made of high strength aluminum, titanium, ceramic, or other suitable materials known to one skilled in the art.

Figure 14:
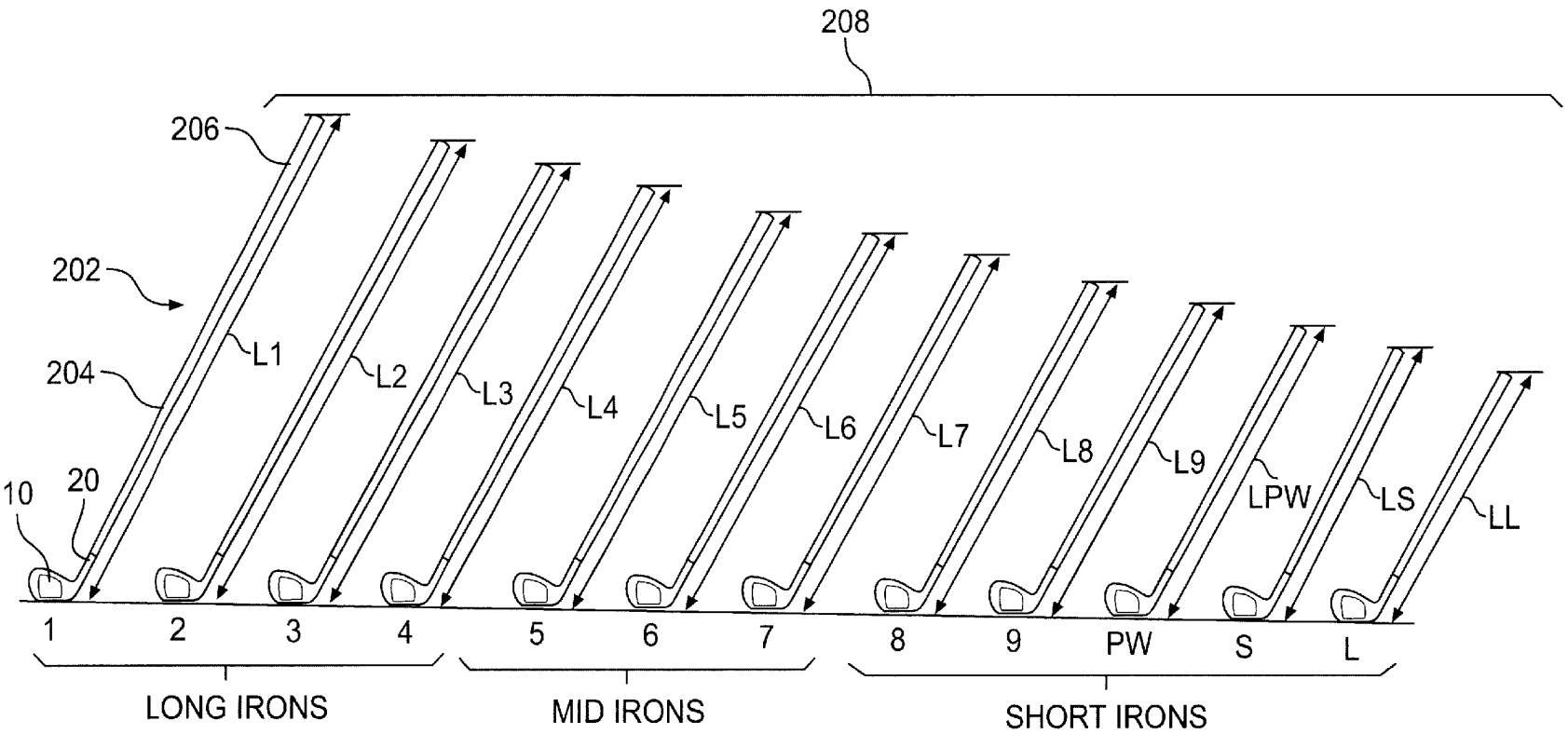
FIG. 14 is a front view of a set of golf clubs of the present invention.

The present invention is also directed to a set of golf clubs. Referring to FIG. 14, golf club head 10 is shown incorporated into a golf club 202, which is a 1 iron. Golf club 202 includes a shaft 204 and a grip region 206. One end of shaft 204 is received within hosel 20. The 1 iron has a length designated L1. Each of the remaining clubs have a length L2–LL. The long-irons are the 1 iron through the 4 iron, the mid-irons are the 5 iron through the 7 iron and the short-irons are the 8 iron through the lob wedge (LW). The short irons include a series of wedges: a pitching wedge PW, a sand wedge SW, and a lob wedge LW. FIG. 14 illustrates that from the long irons to the short irons in a set of clubs 208, the length of the clubs decreases from the long irons to the short irons. The lie angle of each of the clubs can also vary.

Figure 15:
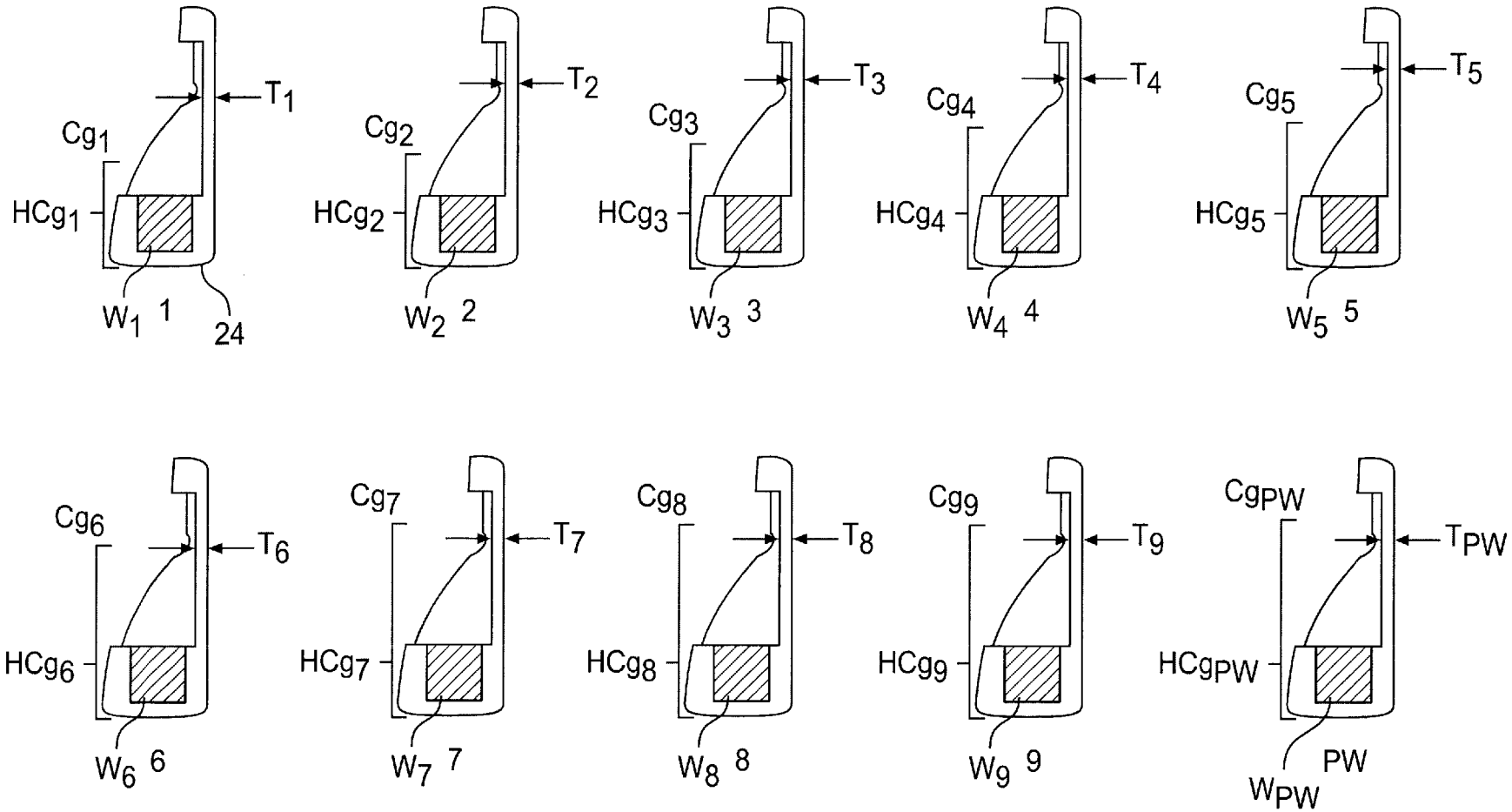
FIG. 15 is a set of cross-sectional views of a set of golf club heads of the present invention.

Referring to FIG. 15, a set of club heads is shown and includes irons numbered from 1 to 9 and a pitching wedge PW. The club heads are shown with an insert 60 and a weight member, as discussed above, although the set could include club heads without the weight member. Each club head has a face thickness $T_x$ indicated, for example, as $T_1$, $T_2$, $T_3$ for club heads 1, 2, 3, respectively. Club head 1 has a face thickness $T_1$ that is less than about 0.125 inches. Face thicknesses $T_2$ to $T_{PW}$ could all be equal to $T_1$; alternatively, each of the face thicknesses $T_1$ to $T_{PW}$ can be different in order to obtain a desired set of club head characteristics. According to a preferred embodiment, each club head has a face thickness that is greater than or equal to that of the next lower numbered club head, thus $T_{PW} \geqq T_9 \geqq T_8 \geqq T_7 \geqq T_6 \geqq T_5 \geqq T_4 \geqq T_3 \geqq T_2 \geqq T_1$.

The center of gravity of each club varies throughout the set. The center of gravity for each club head is indicated in FIG. 15 as Cg, thus club heads 3 and 4 have centers of gravity $Cg_3$ and $Cg_4$, respectively. Each center of gravity is located at a height HCg, which is measured parallel to front face 18 and from the sole 24 to the respective center of gravity. The center of gravity can be varied to produce a set of clubs with desired characteristics by changing the dimensioning and/or materials of the club head. For example, the center of gravity may be manipulated in order to provide a generally consistent peak trajectory along a line throughout the set. According to one preferred embodiment of the present invention, each club has a center of gravity that is located at a height that is equal to or higher than that of a next lowered club, thus $HCg_{PW} \geqq HCg_9 \geqq HCg_8 \geqq HCg_7 \geqq HCg_6 \geqq HCg_5 \geqq HCg_4 \geqq HCg_3 \geqq HCg_2 \geqq HCg_1$.

As also shown in FIG. 15, the club heads may also include a weight member as discussed above. Each weight member has a predetermined weight labeled on FIG. 15 as $W_x$. Thus, club heads 1 and 2 have weight members with weights $W_1$ and $W_2$, respectively. The weights may be configured to provide a desired set of club head characteristics, such as a low center of gravity. According to one embodiment, only some of the clubs in the set may include weight members, such as, for example, the long irons (club heads 1–4). Alternatively, only the short irons (wedges) may include weight members. It is preferred, however, that each club head in the set has a weight member with a weight W that is less than or equal to that of a next lower numbered club. Thus, $W_{PW} \leqq W_9 \leqq W_8 \leqq W_7 \leqq W_6 \leqq W_5 \leqq W_4 \leqq W_3 \leqq W_2 \leqq W_1$.

While it is apparent that the illustrative embodiments of the invention disclosed herein fulfill the objectives stated above, it is appreciated that numerous modifications and other embodiments may be devised by those skilled in the art. The sets of clubs disclosed can include a series of wedges, each with a different loft, such as pitching, lob, gap and sand wedges. The features disclosed to vary the center of gravity, as discussed above, can be used in different combinations. In addition, the center of gravity may be changed from the long irons to the short irons in subsets. Thus, for example, a first group of long irons is provided with a first center of gravity, a second group of mid irons is provided with a second center of gravity, and a group of short irons is provided with a third center of gravity. The vertical position of the center of gravity may be about the same within a group, however, the first center of gravity is the lowest and the second and third centers of gravity increase from the first group to the third group. Therefore, it will be understood that the appended claims are intended to cover all such modifications and embodiments which would come within the spirit and scope of the present invention.

What is claimed is:

1. An iron-type club head comprising:

(a) a front face of substantially uniform thickness, the tbickness being less than about 0.125 inches;

(b) a perimeter weighting surrounding the front face and defining a back cavity therein; and (c) an insert located in at least a portion of the back cavity, the insert being comprised of a lower portion having a first maximum thickness and an upper portion having a second maximum thickness less than or equal to the first and having at least a portion of the upper portion having a thickness less than the first maximum thickness, wherein the perimeter weighting comprising an indentation adjacent the back cavity, and wherein a weight member having a specific gravity of greater than about 10 is coupled into the indentation by the insert.

2. The club head of claim l, wherein the insert further comprises an intermediate portion extending between the upper and lower portions and having a third maximum thickness less than or equal to the second maximum thickness.

3. The club head of claim 1, wherein the front face thickness is less than about 0.115 inches.

4. The club head of claim 1, wherein the insert is adhesively affixed in the back cavity.

5. The club head of claim 1, wherein the insert is press fit into the back cavity.

6. The club head of claim 1, wherein the insert is molded into the back cavity.

7. The club head of claim 1, wherein the perimeter weighting further defines an undercut, and the insert is locked into the back cavity by the undercut.

8. The club head of claim 1, wherein the insert is comprised of fiber reinforced resin.

9. The club head of claim 1, further comprising a vibration absorber located in at least a portion of the back cavity.

10. The club head of claim 9, wherein the vibration absorber is disposed between the insert and the back cavity.

11. The club head of claim 1, wherein the front face defines a striking surface and the striking surface is a material different than that of the perimeter weighting.

12. A set of iron-type club heads wherein each of the club heads comprises:

(a) a front face;

(b) a perimeter weighting surrounding a substantial portion of the front face and defining a back cavity therein; and (c) an insert located in the back cavity, the insert being comprised of a lower portion having a first maximum thickness and an upper portion of having a second maximum thickness less than or equal to the first and having at least a portion of the upper portion having a thickness less than the first maximum thickness; and wherein a first club head within the set has a face thickness of less than 0.125 inches, and wherein each club head further comprises a weight member juxtaposed between the perimeter weighting and the insert, wherein the weight member of each club head within the set has a weight that is equal to or less than a next club head in the set with a lower club number.

13. The set of club heads of claim 12, wherein each club head within the set has a face thickness that is equal to or greater than a next club head in the set with a lower club number.

14. The set of club heads of claim 12, wherein each club head within the set has a center of gravity that is at a height equal to or greater than a next club head in the set with a lower club number.

15. An iron-type club head comprising:

(a) a front face of substantially uniform thickness, the thickness being less than about 0.125 inches;

(b) a perimeter weighting surrounding the front face and defining a back cavity therein; and (c) an insert located in at least a portion of the back cavity, the insert being comprised of a composite fiber reinforced resin to support the front face, wherein the insert comprises a bottom portion having a first maximum thickness and a top portion having a second maximum thickness less than the first, wherein a weight member having a specific gravity of greater than 10 is juxtaposed between the perimeter weighting and the insert.

16. The club head of claim 15, wherein the insert further comprises an intermediate portion extending between the top and bottom portion and having a third maximum thickness less than or equal to the second maximum thickness.

17. The club head of claim 15, wherein the front face thickness is less than about 0.115 inches.

18. The club head of claim 15, wherein the insert is adhesively affixed in the back cavity.

19. The club head of claim 15, wherein the insert is press fit into the back cavity.

20. The club head of claim 15, wherein the insert is molded into the back cavity.

21. The club head of claim 15, wherein the perimeter weighting further defines an undercut, and the insert is locked into the back cavity by the undercut.

* * * * *